US007094184B1

(12) United States Patent
Chen et al.

(10) Patent No.: US 7,094,184 B1
(45) Date of Patent: Aug. 22, 2006

(54) SELF-SOURCING EXERCISE BIKE WITH A LINEAR DIGITAL CONTROL MAGNETIC RESISTANCE BRAKING APPARATUS

(75) Inventors: Yu-Kai Chen, Chiai (TW); Tsai-Fu Wu, Chiai (TW); Sheng-Yu Tseng, Chiai (TW); Hong-Siang Ruei, Sanchung (TW); Chin-Hsiung Chang, Taichung (TW)

(73) Assignee: Fego Precision Industrial Co., Ltd., Taichung (TW)

( * ) Notice: Subject to any disclaimer, the term of this patent is extended or adjusted under 35 U.S.C. 154(b) by 0 days.

(21) Appl. No.: 11/092,923

(22) Filed: Mar. 30, 2005

(51) Int. Cl.
*A63B 21/00* (2006.01)

(52) U.S. Cl. ..... 482/93; 482/8; 482/57; 73/379.06; 73/379.07

(58) Field of Classification Search ..... 482/1–9, 482/51, 57–65, 92, 93, 148, 900–902; 73/379.01, 73/379.07, 379.06
See application file for complete search history.

(56) References Cited

U.S. PATENT DOCUMENTS 5,042,794 A 8/1991 Sun
5,234,083 A 8/1993 Lee
6,027,429 A * 2/2000 Daniels ..... 482/5
6,084,325 A 7/2000 Hsu
6,450,922 B1 * 9/2002 Henderson et al. ..... 482/8
6,908,416 B1 * 6/2005 Mercado et al. ..... 482/52

* cited by examiner

*Primary Examiner*—Glenn Richman
(74) *Attorney, Agent, or Firm*—Troxell Law Office, PLLC

(57) ABSTRACT

A self-sourcing exercise bike with a linear digital control magnetic resistance braking apparatus comprises a generator, a power converter, a digital control system, a magnetic braking resistance and a LED control panel. This apparatus uses a linear control method to control the change of the magnetic resistance, and the magnetic resistance braking apparatus uses a method of changing inductance and a controlling way thereof to achieve the goal of controlling the variation of the magnetic resistance braking force. This bike makes the user or rehabilitant to linearly adjust the resistance force or torque according to the speed of the exercise bike and the presetting resistance force, and easily start up the power system in the initial stage.

4 Claims, 3 Drawing Sheets

SELF-SOURCING EXERCISE BIKE WITH A LINEAR DIGITAL CONTROL MAGNETIC RESISTANCE BRAKING APPARATUS

BACKGROUND OF THE INVENTION

1. Field of the Invention

The present invention relates to a self-sourcing exercise bike with a linear digital control magnetic resistance braking apparatus. In particular, this invention provides a linear control method to control the change of the magnetic resistance, and the magnetic resistance braking apparatus uses a method of changing inductance and a controlling way thereof to achieve the goal of controlling the variation of the magnetic resistance braking force.

2. Description of the Related Art

The exercise bike is a very popular product for exercise or rehabilitation in the house, gymnasium, and hospital. The resistance or brake apparatus in a self-sourcing exercise bike could be divided into friction brake, oil-pressure brake, electric-magnetic brake and eddy-current brake. To sort them by force, the friction brake and oil-pressure brake are belong to contact force, the electric-magnetic brake and eddy-current brake are belong to surpass-distance force. The brake using the contact force has the shortcomings of wearing due to friction, noise, high temperature and the resistance effect is unstable. So, there are so many researches focusing on the brake using the surpass-distance force.

U.S. Pat. No. 5,042,794 titled "Load Applying Device For An Exercise Bicycle" provides a device for applying a load to a rotating shaft of an exercise bicycle that receives the load. When a user places his feet on the pedals of the exercise bicycle and bends and stretches his legs, the transmission gear of a speed increasing mechanism of the exercise bicycle is rotated by the paddles and thereby, a rotor coupled by a bearing to a fixed main shaft of the load applying device is rotated with respect to the main shaft. The rotor is a magnetic conductor. A magnetic field is provided so that the rotor is passing through a beam-like magnetic flux path produced thereby. When the rotor is rotated, the rotor cuts the magnetic field and thereby produces an induced eddy current, causing an eddy current break effect to the rotor. The drawback is that it needs a man-made effort to adjust the distance of the magnet to control the magnetic braking force.

U.S. Pat. No. 5,234,083 titled "Magnetic Brake" provides a magnetic brake having a combined collar and flywheel with a braking disc and a fan that are all rotatably mounted on a shaft fixed between a pair of frames. The magnetic brake further includes an electro-magnetic coil wound on an electromagnetic ferrite core, a plurality of permanent magnets mounted on an inner surface of the collar, and a stator coil wound on a stator ferrite core disposed in a stator ferrite core seat. An electrical circuit is provided having a rectifying circuit coupled to a first voltage regulating circuit for power the stator winding and the other circuitry. A digital-to-analog converter is included for converting an input digital control signal to an analog control signal. The output of the converter is coupled to a second voltage regulator, the output of which is coupled to a current regulating circuit for driving the stator winding. The drawbacks are that the resistance force of the brake is not enough, and the control and the performance of the resistance force are not good.

U.S. Pat. No. 6,084,325 titled "Brake Device With A Combination Of Power-Generating And Eddy-Current Magnetic Resistance" provides a brake device with a combination of power-generating and eddy-current magnetic resistance having an outer ]-shaped fly wheel fastened on a central axis of a frame and fitted with a permanent magnet on the inner circular edge to form a rotor type, and the fly wheel is connected with a stator core fastened on the frame. Moreover, one end of the central axle is stretching out of the frame and fitted with a belt wheel. The front end the frame is fitted with a brake core adjacent to the outer edge of the flywheel to supply a planned eddy current magnetic resistance to the flywheel. The drawbacks are that the resistance force is still not good, the user cannot change the resistance force linearly with the speed and the presetting force, and it is difficult for the user or the rehabilitant to start up in the initial stage.

SUMMARY OF THE INVENTION

An object of the present invention is to provide a self-sourcing exercise bike with a linear digital control magnetic resistance braking apparatus that can achieve the goal of controlling the variation of the magnetic resistance braking force by a method of changing the inductance of inductance magnetic resistance coil, which can make the induced current to be a triangle waveform with different slope.

Another object of the present invention is to provide a self-sourcing exercise bike with a linear digital control magnetic resistance braking apparatus that can make the user or rehabilitant to linearly adjust the resistance force or torque according to the speed of the exercise bike and the presetting resistance force.

Another object of the present invention is to provide a self-sourcing exercise bike with a linear digital control magnetic resistance braking apparatus that can help the user or rehabilitant to easily start up the power system in the initial stage.

In order to achieve the above goal, the present invention provides a self-sourcing exercise bike with a linear digital control magnetic resistance braking apparatus. The exercise bike comprises a generator, a power converter, a digital control system, a magnetic braking resistance and a LED control panel.

The generator is a permanent magnetic three phases induction generator for generating power. The power converter is a switching power converter for converting the electric energy of the generator. The digital control system includes a rotating speed detection circuit for feeding back the rotation speed of the fly wheel, a resistance level transfer circuit for detecting the presetting resistance level, a driving control circuit for generating a square wave of resistance control, a micro process controller which includes a linear magnetic resistance braking control table for the user or rehabilitant to linearly adjust the resistance force or torque according to the speed of the exercise bike and the presetting resistance force, and a zero start-up magnetic resistance driving circuit for making the user or rehabilitant to easily start up the power system in the initial stage. The magnetic braking resistance includes a changeable inductance electromagnet, which is composed by a Ferrite core, a changeable inductance magnetic resistance coil and a dc bias voltage coil, a discharge load for providing a discharge load for the changeable inductance. A pulsating current is used to control the magnetic field of the electromagnet to increase the torque.

For further understanding of the invention, reference is made to the following detailed description illustrating the embodiments and examples of the invention. The description is only for illustrating the invention and is not intended to be considered limiting the scope of the claim.

BRIEF DESCRIPTION OF THE DRAWINGS

The drawings included herein provide a further understanding of the invention. A brief introduction of the drawings is as follows.

DETAILED DESCRIPTION OF THE PREFERRED EMBODIMENTS

Figure 1:
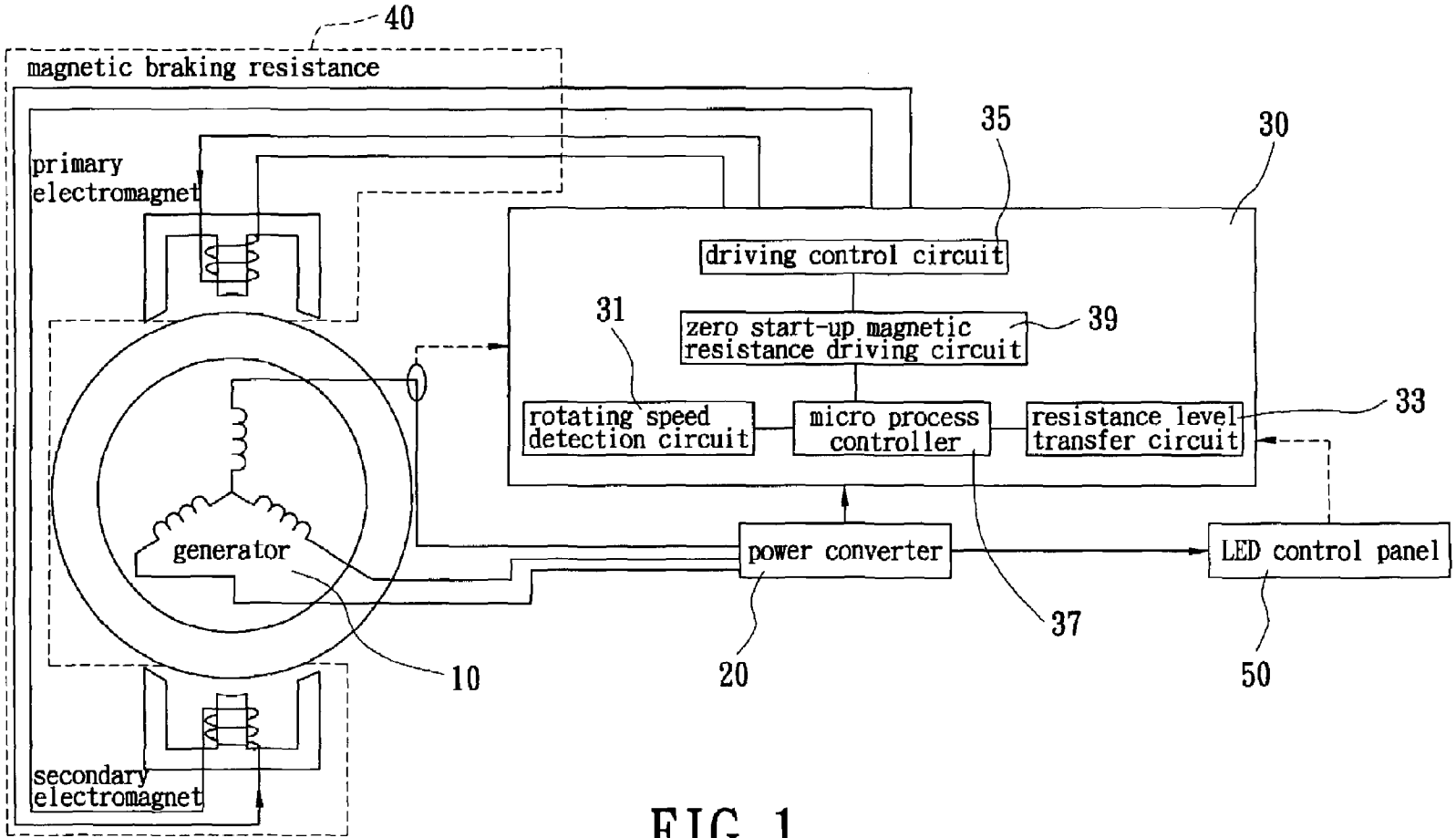
FIG. 1 is a schematic diagram of the system framework of the present self-sourcing exercise bike with a linear digital control magnetic resistance braking apparatus.

Referring to FIG. 1, the present invention provides a self-sourcing exercise bike with a linear digital control magnetic resistance braking apparatus. The exercise bike comprises a generator 10, a power converter 20, a digital control system 30, a magnetic braking resistance 40 and a LED control panel 50.

The generator 10 is a permanent magnetic three phases induction generator. It transfers the mechanical energy from the user or rehabilitant pedaling the bearing to rotate the induction armature of the permanent magnetic three phases induction generator to generate electric power. It provides the power for the digital control system 30, the magnetic braking resistance 40 and the LED control panel 50 through the power converter 20. The rotating bearing is a permanent magnet and fastens by a flywheel in the outer ring.

The power converter 20 is a switching power converter for converting the electric energy of the permanent magnetic three phases induction generator 10 to the power supplying for the digital control system 30, the magnetic braking resistance 40 and the LED control panel 50. The switching power converter transfers the power by using a switching transfer circuit through a pulse width modulation control method.

The digital control system 30 includes a rotating speed detection circuit 31 coupled to the power output side of the permanent magnetic three phases induction generator 10 for feeding back the rotation speed of the fly wheel, a resistance level transfer circuit 33 coupled to the LED control panel 50 for detecting and transferring the presetting resistance level, a driving control circuit 35 for generating a square wave of resistance control, a micro process controller 37 which is embedded a linear magnetic resistance braking control table for the user or rehabilitant to linearly adjust the resistance force or torque according to the speed of the exercise bike and the presetting resistance force, and a zero start-up magnetic resistance driving circuit 39 connected to a driving control circuit 35 of the digital control system 30 makes the user or rehabilitant to easily start up the power system of the bike in the initial stage.

Figure 2:
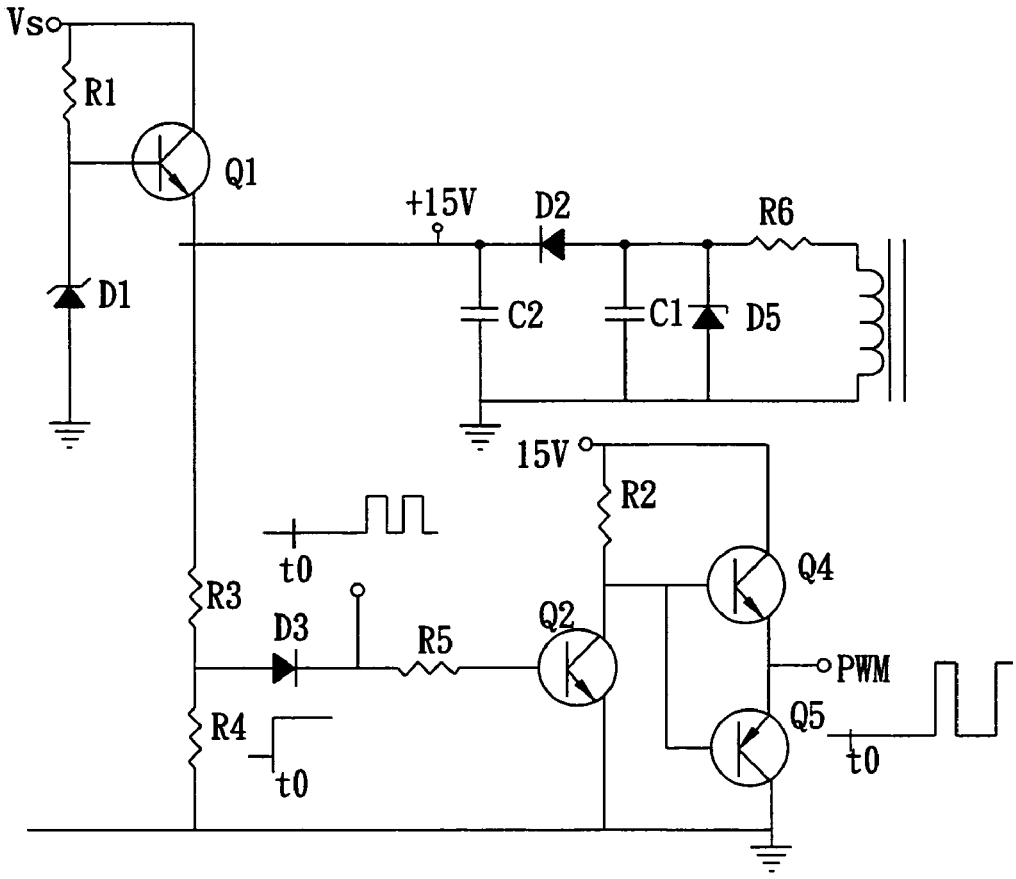
FIG. 2 is a circuit diagram of zero start-up magnetic resistance driving circuit.

FIG. 2 shows the zero start-up magnetic resistance driving circuit 39. The zero start-up magnetic resistance driving circuit 39 utilizes the power of the power converter 20 to acquire a voltage signal applying to a common emitter transistor, in order to achieve the goal of zero magnetic resistance start-up procedure. When power is being on, divides the power voltage (+15V) by resistor R3 and R4 to get a fixed voltage and applies the voltage to the common emitter transistor, to make the PWM output is low and the magnetic force is zero. When the system enters steady state, the micro process controller 37 outputs a correct magnetic signal and controls the magnetic signal.

Figure 3:
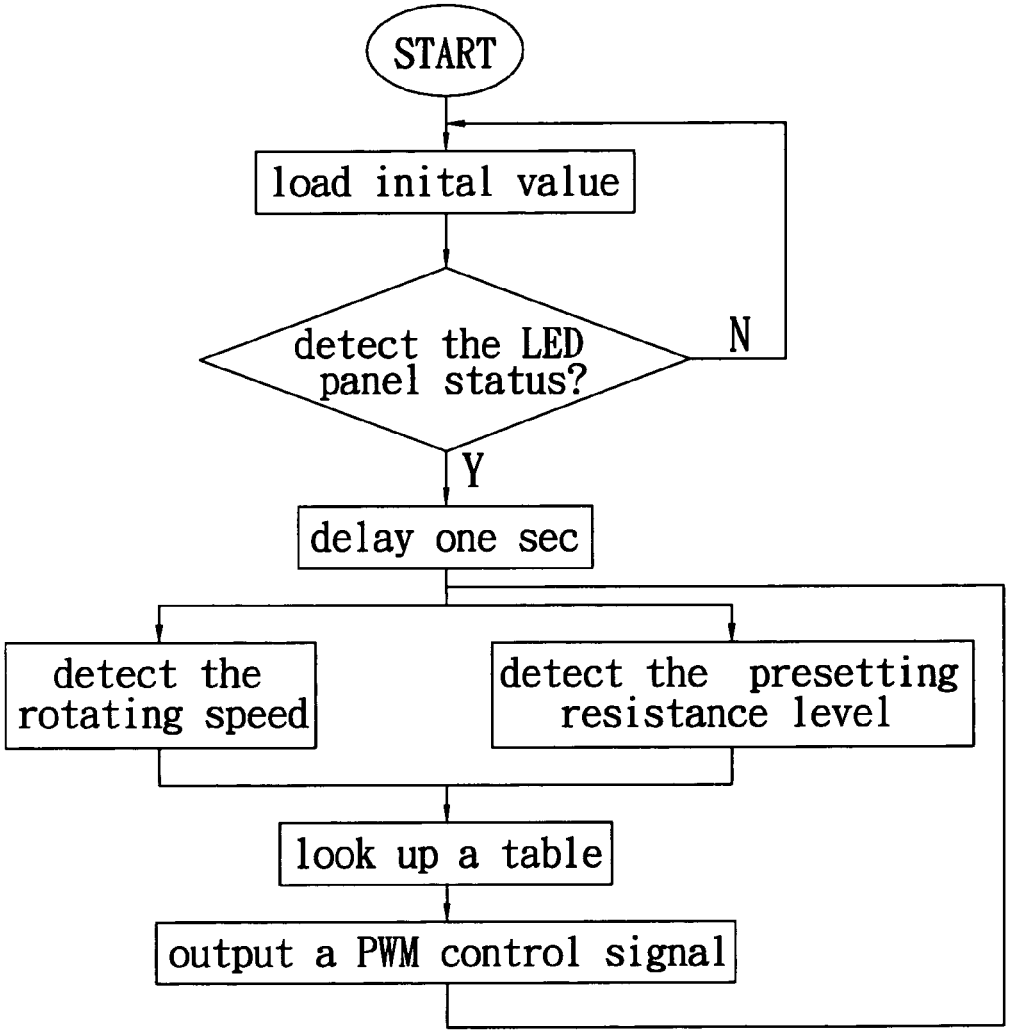
FIG. 3 is a flow chart of system control of the digital control system for the present self-sourcing exercise bike with a linear digital control magnetic resistance braking apparatus.

The FIG. 3 shows the flow chart of system control of the digital control system 30. The flow chart of system control comprises the following steps:

Loading the initial value of the micro process controller, including the initial values of an operating amplifier, a PWM controller, an A/D converter and I/O ports.

Checking the LED panel status, to make sure whether the bike is ready or not.

Delaying one second to achieve two purposes. One is to make sure the feedback signal and the reference signal are in steady state. Another one is to achieve the goal of zero magnetic resistance start-up procedure.

Detecting the rotating speed of the rotor of the generator and the presetting resistance level.

Looking up the table, according to the rotating speed of the rotor of the generator and the presetting resistance level to get a weighting value, in order to achieve the goal of linearly adjusting the resistance force or torque.

Outputting a PWM control signal through a PWM controller to a driving control circuit.

The magnetic braking resistance 40 includes a changeable inductance electromagnet, which is composed of a Ferrite core, a changeable inductance magnetic resistance coil and a dc bias voltage coil, fixed to the shaft of the rotating flywheel of the bike. It changes the magnetic flux in the inner of the Ferrite core by inputting a pulsating current into the dc bias voltage coil. At the same, introduces a high frequency square waveform into the changeable inductance magnetic resistance coil to produce a current of a triangle waveform with different slope, which flows through the changeable inductance magnetic resistance coil. By this way, the pulsating current is used to control the magnetic field of the electromagnet to increase the torque and to improve the performance of the conventional self-sourcing magnetic braking exercise bikes. The maximum torque of the bike can be increased to 1.87~2.86 times than that of the conventional magnetic braking bikes. The magnetic braking resistance 40 also comprises a discharge load for providing a discharge load for the changeable inductance. The discharge load could be an electromagnet coil, a resistor or an impedance component.

The description above only illustrates specific embodiments and examples of the invention. The invention should therefore cover various modifications and variations made to the herein-described structure and operations of the invention, provided they fall within the scope of the invention as defined in the following appended claims.

What is claimed is:

1. A self-sourcing exercise bike with a linear digital control magnetic resistance braking apparatus, comprising:

a LED control panel;

a generator, which is a permanent magnetic three phases induction generator for generating power;

a power converter, which is a switching power converter for converting the electric energy of the generator;

a digital control system, which includes a rotating speed detection circuit coupled to the power output side of the permanent magnetic three phases induction generator for feeding back the rotation speed of the fly wheel, a resistance level transfer circuit coupled to the LED control panel for detecting the presetting resistance level, a driving control circuit for generating a square wave of resistance control, a micro process controller which is embedded a linear magnetic resistance braking control table for the user or rehabilitant to linearly adjust the resistance force or torque according to the speed of the exercise bike and the presetting resistance force, and a zero start-up magnetic resistance driving circuit connected to the driving control circuit for making the user or rehabilitant to easily start up the power system in the initial stage; and a magnetic braking resistance, which includes a changeable inductance electromagnet composed of a Ferrite core, a changeable inductance magnetic resistance coil and dc bias voltage coil, and a discharge load for providing a discharge load for the changeable inductance, wherein a pulsating current is used to control the magnetic field of the electromagnet to increase the torque.

2. The self-sourcing exercise bike with a linear digital control magnetic resistance braking apparatus of claim 1, wherein the switching power converter uses a pulse width modulation control method.

3. The self-sourcing exercise bike with a linear digital control magnetic resistance braking apparatus of claim 1, wherein the discharge load is an electromagnet coil, a resistor or an impedance component.

4. A control method for a self-sourcing exercise bike with a linear digital control magnetic resistance braking apparatus, the self-sourcing exercise bike comprises a generator, a power converter, a digital control system, a magnetic braking resistance and a LED control panel, the control method comprising:

loading the initial value of the micro controller, including the initial values of an operating amplifier, a PWM controller, an A/D converter and I/O ports;

checking the LED panel status, to make sure whether the bike is ready or not;

delaying one second, to make sure the feedback signal and the reference signal are in steady state and to achieve the goal of zero magnetic resistance start-up procedure;

detecting the rotating speed of the rotor of the generator and the presetting resistance level;

looking up the table, according to the rotating speed of the rotor of the generator and the presetting resistance level to get a weighting value, achieving the goal of linearly adjusting the resistance force or torque; and outputting a PWM control signal through a PWM controller to a driving control circuit.

* * * * *